US006142228A

United States Patent [19]

Jogi et al.

[11] Patent Number: 6,142,228

[45] Date of Patent: Nov. 7, 2000

[54] DOWNHOLE MOTOR SPEED MEASUREMENT METHOD

[75] Inventors: Pushkar N. Jogi, Houston, Tex.; Thomas A. Nagelhout, Lindenhurst, Ill.

[73] Assignee: Baker Hughes Incorporated, Houston, Tex.

[21] Appl. No.: 09/150,108

[22] Filed: Sep. 9, 1998

[51] Int. Cl.[7] ..... E21B 47/00

[52] U.S. Cl. ..... 166/250.01; 175/50; 702/6; 367/75

[58] Field of Search ..... 166/250.01; 175/39, 175/40, 24, 27, 45, 50; 702/6, 7, 9; 367/75; 388/809

[56] References Cited

U.S. PATENT DOCUMENTS

| | | | |
|---|---|---|---|
| 5,224,201 | 6/1993 | Kruger | 388/809 |
| 5,303,203 | 4/1994 | Kingman | 367/75 |
| 5,375,098 | 12/1994 | Malone | 175/40 |
| 5,842,149 | 11/1998 | Harrell | 175/45 |
| 5,864,058 | 1/1999 | Chen | 175/39 |
| 5,924,499 | 7/1999 | Birchak | 175/40 |
| 5,941,305 | 8/1999 | Thrasher | 166/250.01 |

OTHER PUBLICATIONS

Randall, R.B., *Frequency Analysis*, 3rd Edition, Sep., 1987, pp. 234–238.

Vandiver, J. Kim, et al., "Case Studies of the Bending Vibration and Whirling Motion of Drill Collars", SPE Drilling Engineering, Dec., 1990, pp. 282–290.

Thrane, N.; "The Discrete Fourier Transform and FFT Analyzers," date unknown, pp. 3–25.

Bogert, Bruce P.; "Informal Comments on the Uses of Power Spectrum Analysis," IEEE Transactions on Audio and Electroacoustics, vol. AU–15, No. 2, Jun., 1967, pp. 74–76.

Welch, Peter D.; "The Use of Fast Fourier Transform for the Estimation of Power Spectra: A Method Based on Time Averaging Over Short, Modified Periodograms," IEEE Transactions on Audio and Electroacoustics, vol. AU–15, No. 2, Jun., 1967, pp. 70–73.

Cooley, James W., et al.; "An Algorithm for the Machine Calculation of Complex Fourier Series," date unknown, pp. 297–301.

*Primary Examiner*—Roger Schoeppel

*Attorney, Agent, or Firm*—Duane, Morris & Heckscher LLP

[57] ABSTRACT

The operating speed of a rotor in a progressive-cavity Moineau-type pump is determined on a real-time basis using frequency analysis of vibration or pressure data to ultimately compute the rotor speed. Vibration and pressure or bending moment and axial acceleration data can be used to compute the rotor rotational frequencies. A high-amplitude peak in the frequency domain in any of the data sets which corresponds to the motor whirl frequency given by $\omega_m N_r$, where $\omega_m$ represents the motor frequency in radians per second and $N_r$ represents the number of lobes in the rotor, can be isolated. The motor rpm therefore equals $\omega_m/2\pi.60$. In addition, modulated frequency peaks such as $N_r(\omega_m+n\omega_s)$ and $N_r(\omega_m-n\omega_s)$, where the modulating frequency is the pump stroke frequency $\omega_s$, can also be observed. There is a coupling between the two measurements, such as a linear coupling between the bending moment and axial acceleration, as well as between fluid and the motor. Using dual-channel analysis of the data, and employing a known technique of computing the coherent output power of the two signals, the method causes an enhancement of common frequencies in the two signals and an elimination of noise. The whirl frequency and the modulated frequency components are isolated so that the motor speed can be easily computed from the isolated whirl or modulated whirl frequencies on a real-time basis.

19 Claims, 20 Drawing Sheets

DOWNHOLE MOTOR SPEED MEASUREMENT METHOD

FIELD OF THE INVENTION

The field of this invention relates to employment of frequency data in a method to compute downhole motor speeds.

BACKGROUND OF THE INVENTION

Downhole motors are frequently used in drilling operations, particularly in deviated wellbores. A common type of motor used for such operations is a progressing cavity-type motor that works on the Moineau principle. This type of a motor is a positive-displacement type which operates on circulated drilling fluid pumped through cavities of an elastomer internal helix stator, which in turn transfers force into rotational power by turning a steel external helix rotor. The rotor rotates inside the stator in an eccentric manner. The eccentric rotary motion of the rotor is converted into bit rotary motion by connecting the lower end of the rotor to the output shaft leading to the bit through a universal joint coupling. These types of motors can have a single lobe rotor rotating inside a two-lobe stator or can have multi-lobe stator/rotor combinations. The rotor has one less lobe than the stator.

Characteristic curves are provided by manufacturers of downhole motors which are typically used by field personnel to compute the operating speed of the motor and, hence, the rotational speed of the bit. The bit speed is of critical importance during the drilling operation. The bit speed and torque of a positive displacement motor are computed using information on flow rate and pressure drop in the motor, and using such data in performance charts provided by the manufacturer. The result is a method which is not an accurate predictor of the rotor speed. It is thus an objective of the present invention to provide a technique to measure the rotor speed of the positive-displacement motor, particularly when such a motor is part of a bottomhole assembly which incorporates measurement-while-drilling tools. Another objective is to provide efficient and cost-effective drilling by accurate knowledge on a real-time basis of the rotational speed of the bit. To accomplish the object of the present invention, measurements of vibrations generated in the bottomhole assembly during the downhole motor operation are employed.

When drilling with a slightly bent collar, violent lateral vibrations can occur. The bending or sag of the drill collar can occur due to an initial bend or curvature in the collar, sag from gravity and compressional loads, particularly in inclined boreholes or when an unbalanced collar is included in the bottomhole assembly. Centrifugally induced bowing of a collar, in combination with its rotation about the borehole's centerline and about its own center, can cause the collar to whirl in a complicated manner that results in chaotic lateral displacements, impacts and friction at the borehole wall. The magnitude of these centrifugally induced unbalanced forces is proportional to collar mass eccentricity and the square of the rotational rate. Whirling can be destructive when the rotation rate of the assembly equals the natural frequency of the shaft in bending. In a drilling environment, wall contact with a borehole restricts bottomhole assembly deflection. Undesirable consequences, such as surface abrasion caused by forward synchronous whirl and fatigue failures which are caused by backward whirl do, in fact, occur. In backward whirl, the drill collar makes a continuous contact with the borehole wall without slip and the collar center rotates about the borehole center at high rotational rates in a direction opposite to the imposed direction of pipe rotation. Forward synchronous whirl involves the same side of the drillstring making contact with the borehole while rotating.

In a progressive-cavity downhole motor, where the rotor rotates inside a stator in an eccentric manner, the rotor is prone to vibrational characteristics associated with whirling. The rotor center rotates at speed many times greater than the output speed of the shaft leading to the bit and the direction of the eccentric motion of the rotor is opposite to the direction of bit rotation. As a result of eccentric motion, the high rotor whirl speed creates large dynamic unbalanced forces which cause large dynamic loads on the bottomhole assembly. Because the fluid flows between the rotor and stator, there is a coupling between the fluid and the rotor inside the stator, with resulting pressure fluctuations or disturbances which are generated in the fluid at frequencies given by the rotor whirl frequency. Thus, the primary pressure signal in the fluid is modulated because of its coupling or linkage to the whirling action of the rotor. The whirl frequency of eccentric motion of the rotor, $\omega_{mw}$, is given by $\omega_{mw}=\omega_m N_r$ where $\omega_m$ represents the output shaft frequency in radians per second and $N_r$ represents the number of rotor lobes in the motor. Frequencies generated by surface pumping equipment, which circulates mud through the downhole motor which impinges on the rotor lobe, cause pressure fluctuations within the mud at a rate given by $N_r\omega_s$ where $\omega_s$ is the frequency of pump strokes in radians per second. Since the pressure fluctuations in the mud and the drillstring are coupled, the primary rotor signal given by $\omega_m N_r$ is modulated by the hydraulic signal $N_r\omega_s$. The resulting modulated whirl frequency signals are therefore given by $N_r(\omega_m+n\omega_s)$ and $N_r(\omega_m-n\omega_s)$, where n is an integer.

The derivation for the modulated whirl frequency signals in vibration data is illustrated by letting $s_1$ and $s_2$ represent two signals with frequencies $N_r f_1$ and $nN_r f_2$. If $d_1$ and $d_2$ represent the corresponding DC offsets, then $$s_1=A_1 \sin(2\pi N_r f_1)+d_1$$

$$s_2=A_2 \sin(2\pi n N_r f_2)+d_2$$

The modulated signal is, therefore, given by $$s_1.s_2=A_1 \sin(2\pi N_r f_1).A_2 \sin(2\pi n N_r f_2)+d_2 A_1 \sin(2\pi N_r f_1)+d_1 A_2 \sin(2\pi n N_r f_2)+d_1 d_2$$

Therefore, if $f_1=\omega_m/2\pi$, $f_2=\omega_s/2\pi$, $A_m=A_1$, $A_s=A_2$, $d_m=d_1$ and $d_s=d_2$ where $\omega_m$ and $A_m$ represent the circular frequency and amplitude of the mud motor signal and $\omega_s$ and $A_s$ are for pump strokes signal, respectively, then $$s_1.s_2=0.5A_m A_s\,[\cos\{N_r(\omega_m-n\omega_s)\}-\cos\{N_r(\omega_m+n\omega_s)\}]+d_s A_m \sin(N_r\omega_m)+d_m A_s \sin(N_r\omega_s)+d_m d_s$$

Additionally, if $d_m=0$ and $d_s>0$, i.e., the signal due to pump strokes has a nonzero DC component, then the modulated signal has three components:

$$0.5A_m A_s \cos\{N_r(\omega_m-n\omega_s)\}$$

$$0.5A_m A_s \cos\{N_r(\omega_m+n\omega_s)\}$$

$$d_s A_m \sin(N_r\omega_m)$$

Because of coupling between fluid and the rotor inside the stator, the large dynamic loads on the BHA could cause pressure fluctuations in the fluid given by whirl frequency $N_rW_r$. Therefore, the primary pressure signal $n\omega_s$ gets modulated by the rotor whirl frequency as $(n\omega_s+N_r\omega_m)$ and $(n\omega_s-N_r\omega_m)$. The derivation of this result in the pressure data is obtained by letting $s_1$ and $s_2$ represent two signals with frequencies $N_rf_1$ and $nf_2$. If $d_1$ and $d_2$ represent the corresponding DC offsets, then $$s_1=A_1 \sin(2\pi N_r f_1)+d_1$$

$$s_2=A_2 \sin(2\pi n f_2)+d_2$$

Therefore, if $f_1=\omega_s 2\pi$, $f_2=\omega_m/2\pi$, $A_s=A_1$, $A_m=A_2$, $d_s=d_1$ and $d_m=d_2$ where $\omega_s$ and $A_s$ represent the circular frequency and amplitude of the pump strokes signal and $\omega_m$ and $A_m$ represents the corresponding values for the motor signal. The modulated signal as before is given by:

$$s_1.s_2=0.5A_sA_m[\cos(n\omega_s+N_r\omega_m)-\cos(n\omega_s-N_r\omega_m)]+d_mA_s \sin(n\omega_s)+d_sA_m \sin(N_r\omega_m)+d_sd_m$$

In this case, the modulated pressure signal has four components:

$$0.5A_sA_m \cos(n\omega_s-N_r\omega_m)$$

$$0.5A_sA_m \cos(n\omega_s+N_r\omega_m)$$

$$d_mA_s \sin(n\omega_s)$$

$$d_sA_m \sin(N_r\omega_m)$$

Other additional frequencies can also be detected on the plots of elapsed time vs. frequency which are called spectrograms. Modulated frequencies $\omega_mN_r-\omega_c$ due to rotor whirling, bit rotational frequency $\omega_m+\omega_c$ due to output shaft rotation where $w_c$ is the collar rotational frequency, and modulated rotor frequency $\omega_m\pm\omega_s$ due to pump stroke frequency $w_s$, and other frequencies such as $\omega_m$, $\omega_s$, and $\omega_c$, which can be seen on bending moment or vibration spectrograms. The frequencies $\omega_mN_r$ and $\omega_s$ can also be seen on the pressure spectrogram.

The object of the method is to use vibration and pressure data to pinpoint the frequency due to rotor whirl or modulated rotor whirl due to fluid interaction and then compute rotor speed from a formula associating whirl frequency to rotor speed.

SUMMARY OF THE INVENTION

Motor response can normally be obtained by analyzing measured bending vibrations of the bottomhole assembly. Because of coupling between bending vibrations and axial forces, it is conceivable that axial vibration data could provide similar information. Similarly, by virtue of coupling between rotor and fluid inside a stator, both vibration and pressure sensors could provide information on motor response.

The operating speed of a rotor in a progressive-cavity Moineau-type pump is determined on a real-time basis using frequency analysis of vibration or pressure data to ultimately compute the rotor speed. Vibration and pressure or bending moment and axial acceleration data can be used to compute the rotor rotational frequencies. A high-amplitude peak in the frequency domain in any of the data sets which corresponds to the motor whirl frequency given by $\omega_mN_r$, where $\omega_m$ represents the motor frequency in radians per second and $N_r$ represents the number of lobes in the rotor, can be isolated. The motor rpm therefore equals $\omega_m/2\pi.60$. In addition, modulated frequency peaks such as $N_r(\omega_m+n\omega_s)$ and $N_r(\omega_m-n\omega_s)$, where the modulating frequency is the pump stroke frequency $\omega_s$, can also be observed. There is a coupling between the two measurements, such as a linear coupling between the bending moment and axial acceleration, as well as between fluid and the motor. Using dual-channel analysis of the data, and employing a known technique of computing the coherent output power of the two signals, the method causes an enhancement of common frequencies in the two signals and an elimination of noise. The whirl frequency and the modulated frequency components are isolated so that the motor speed can be easily computed from the isolated whirl or modulated whirl frequencies on a real-time basis.

BRIEF DESCRIPTION OF THE DRAWINGS

FIG. 7 represents the spectrogram of the data and FIG. 8 gives the autospectra of the data at the indicated time using the Fast Fourier Transform (FFT) technique.

DETAILED DESCRIPTION OF THE PREFERRED EMBODIMENT

Figure 1:
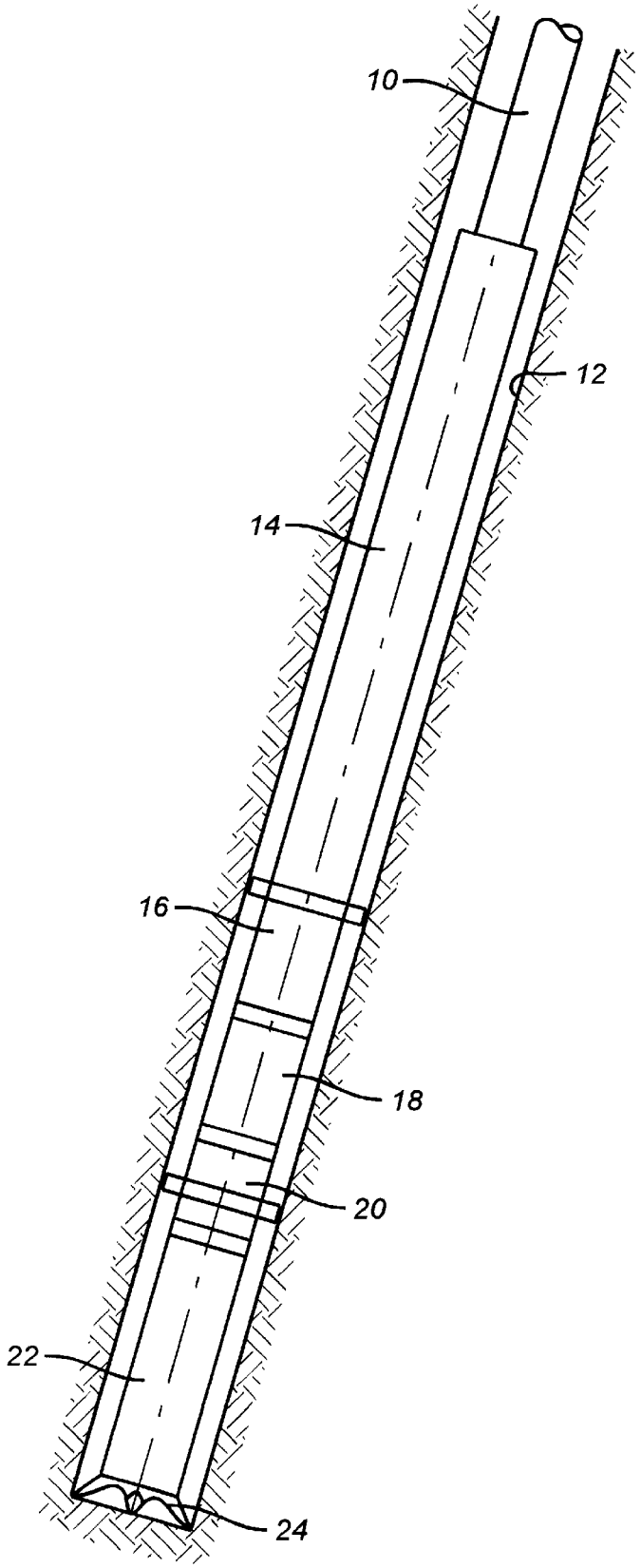
FIG. 1 is a sectional elevational view of a bottomhole assembly used to acquire some of the data in the description of the preferred embodiment.

In order to describe the preferred embodiment, the assemblies used to obtain the data from which the method is developed, must first be described. Referring to FIG. 1, a drill string 10 extends from the surface into borehole 12. The drillstring 10 typically includes one or more drill collars 14. Below the drill collars is a measurement-while-drilling (MWD) tool 16 of a type well-known in the art. Below the MWD tool is a near-bit mechanic's tool (NBM) 18, which is of a type well-known in the art. The downhole Moineau-type motor 20 is mounted below the NBM tool 18. A core barrel 22 is mounted below the downhole motor 20, with the bit 24 at the bottom. The specific motor 20 used to obtain the data illustrated in FIGS. 5–12 was a Navi Drill 6¾" Mach 1C (5:6).

Figure 2:
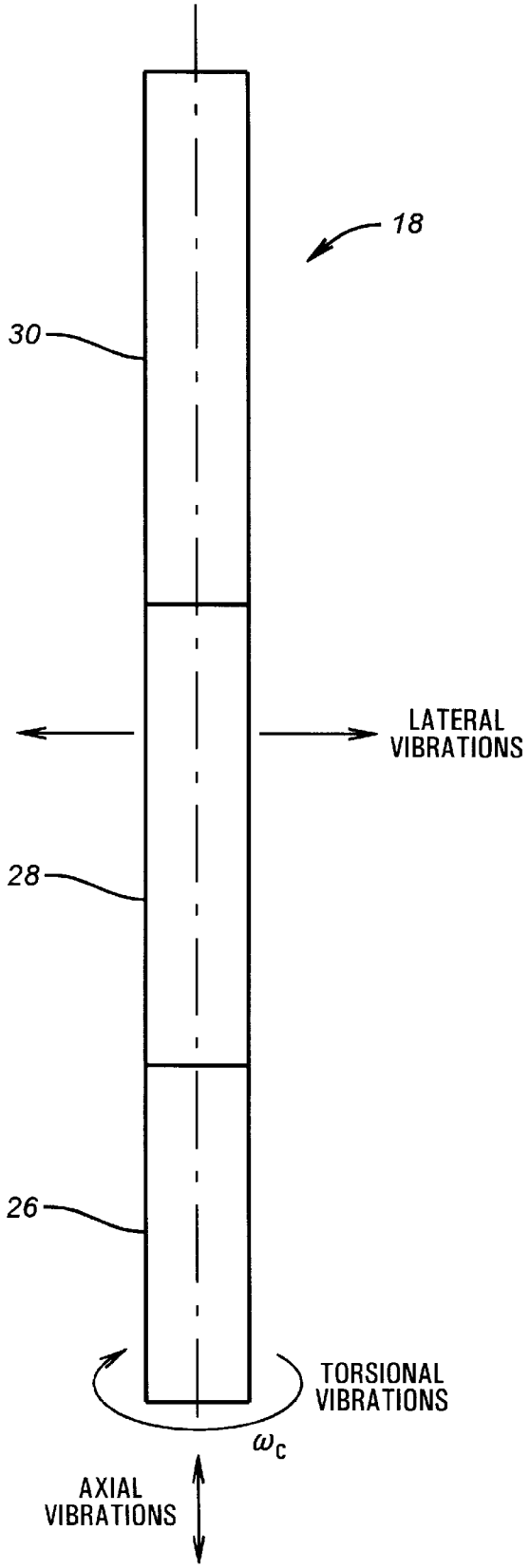
FIG. 2 is a detailed view of a portion of the assembly of FIG. 1, illustrating schematically the components of the near bit mechanics (NBM) tool.

FIG. 2 illustrates the NBM tool 18 in more detail. The NBM tool 18 comprises a two-axis magnetic meter assembly 26 to continuously monitor bottomhole assembly rotation. A 3-axis accelerometer assembly 28 is used to detect bottomhole assembly motion. A strain gauge assembly 30 measures weight-on-bit, torque-on-bit, and bending moment in two orthogonal directions. As a result, the NBM tool 18 can make the following downhole measurements: axial or z-acceleration, bending moments in the x and y directions, magnetometer measurements in the x and y directions, and torque-on-bit and weight-on-bit measurements. Short data intervals, such as 20-second bursts with 40 seconds delay between bursts, of raw measurements, sampled at 100 Hz, are recorded and stored in the NBM sub 18 memory. The MWD tool 16, which includes the directional sensors for inclination and azimuth measurements, gamma ray resistivity, density and other measurements, also processes the data from the NBM tool 18 at the rig for various real-time analyses.

Figure 3:
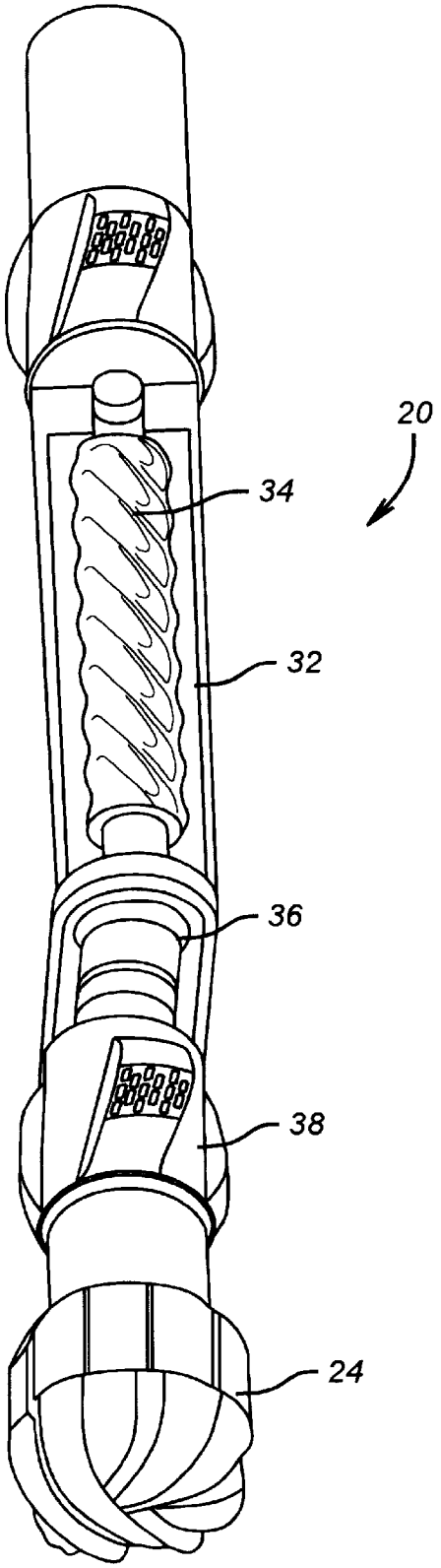
FIG. 3 is a perspective view of the downhole motor, bent sub and bit as they are connected in the wellbore for drilling.

FIG. 3 illustrates a cutaway view of the downhole motor 20, illustrating the stator 32 and the rotor 34. The rotor 34 is connected to a universal joint 36, which is in turn connected through bearing assembly 38 to the bit 24.

Figure 4:
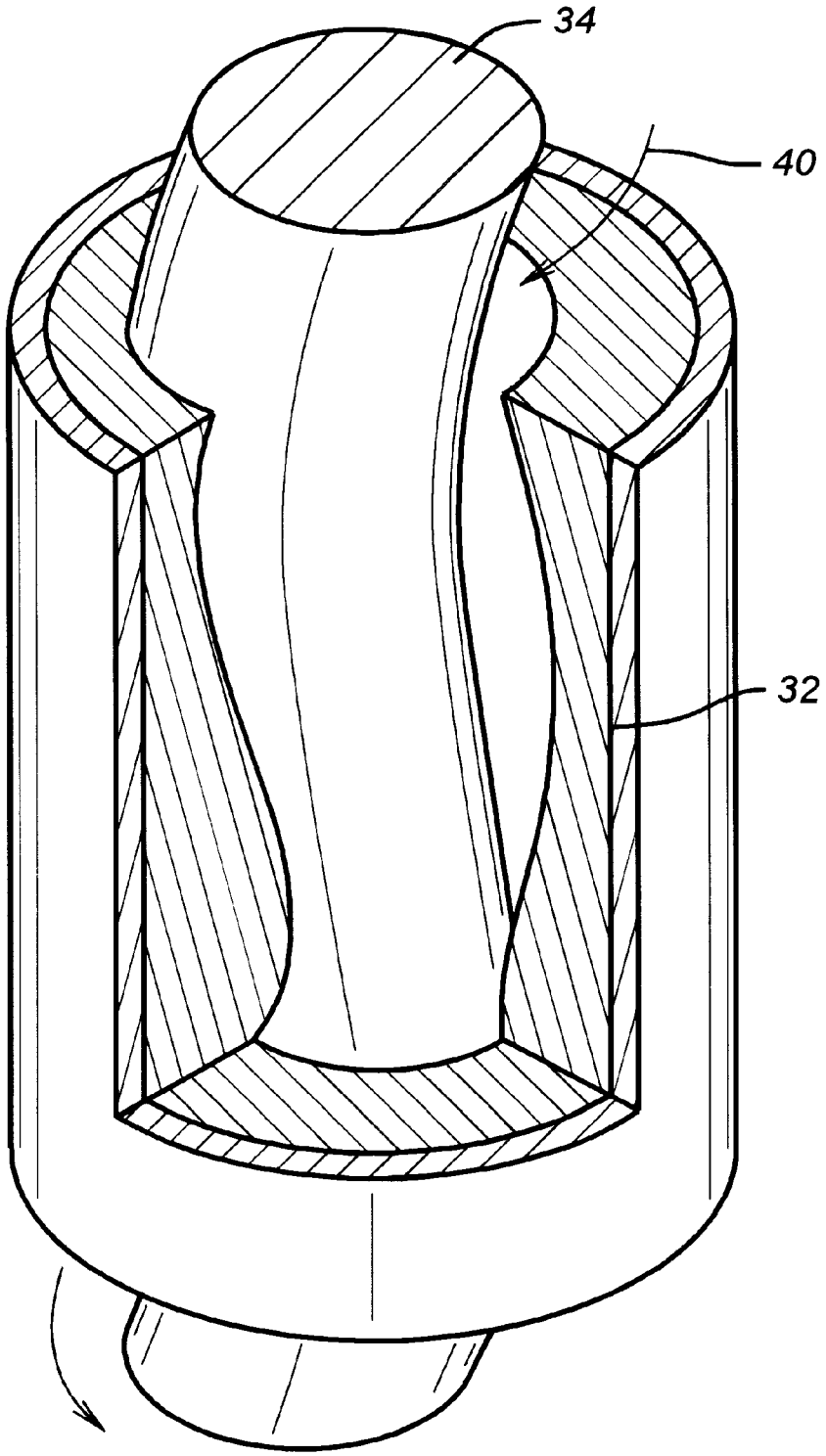
FIG. 4 is a partial view of the rotor of the downhole motor shown with the stator cut away.

FIG. 4 illustrates in more detail the rotor 34 within the stator 32, with arrow 40 indicating the direction of mud flow which induces rotation of rotor 34, as well as the whirling of the rotor centerline about the stator centerline, as described previously.

The data reflected in FIGS. 13–20 was also obtained from downhole motor tests, using accelerometers, strain gauges, and pressure sensors, and a triplex pump to provide the motive fluid passing through the pump. More particularly, the data reflected in FIGS. 13–20 was obtained using a 6¾" Mach 1 (⅚ lobes) and a 6¾" Mach 2 (½ lobes) motors, each driven by a Gardener/Denver PZ7 triplex pump.

Figure 5:
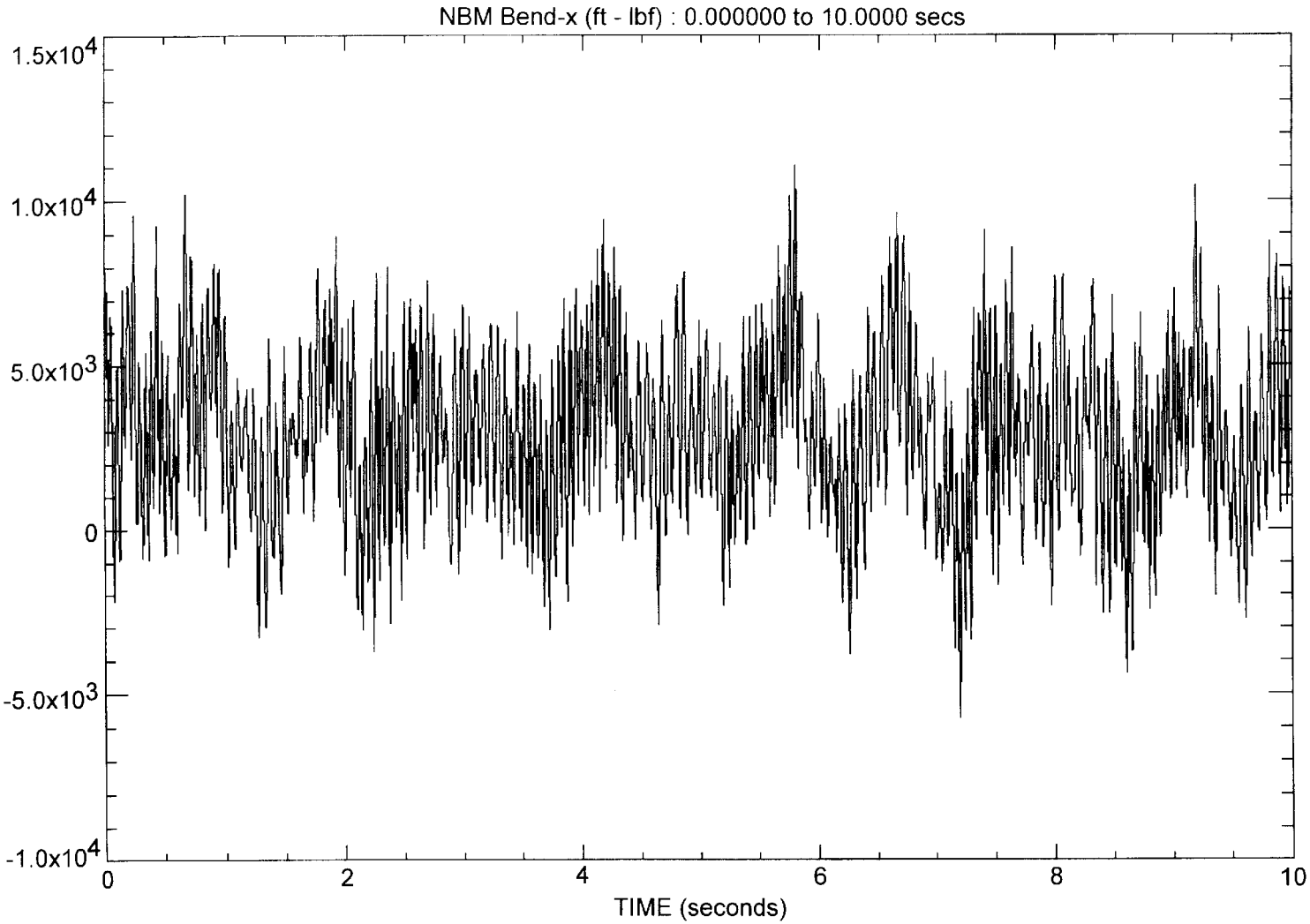
FIGS. 5 and 6 show raw data from one of the sensors on the bottomhole assembly illustrated in FIG. 1, showing, respectively, a plot of bending moment and z-axis acceleration amplitude plotted against time.
Figure 6:
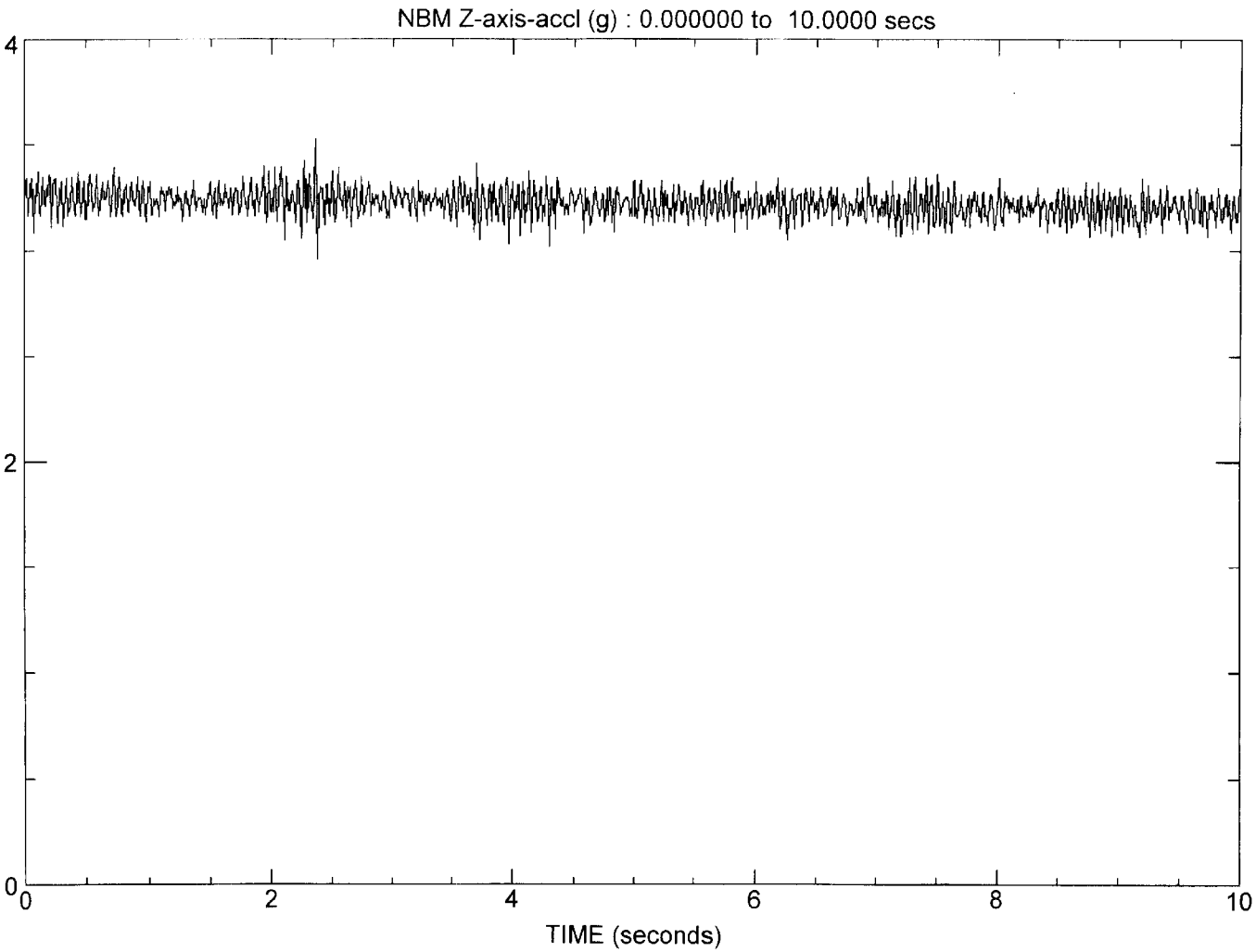
Figure 7:
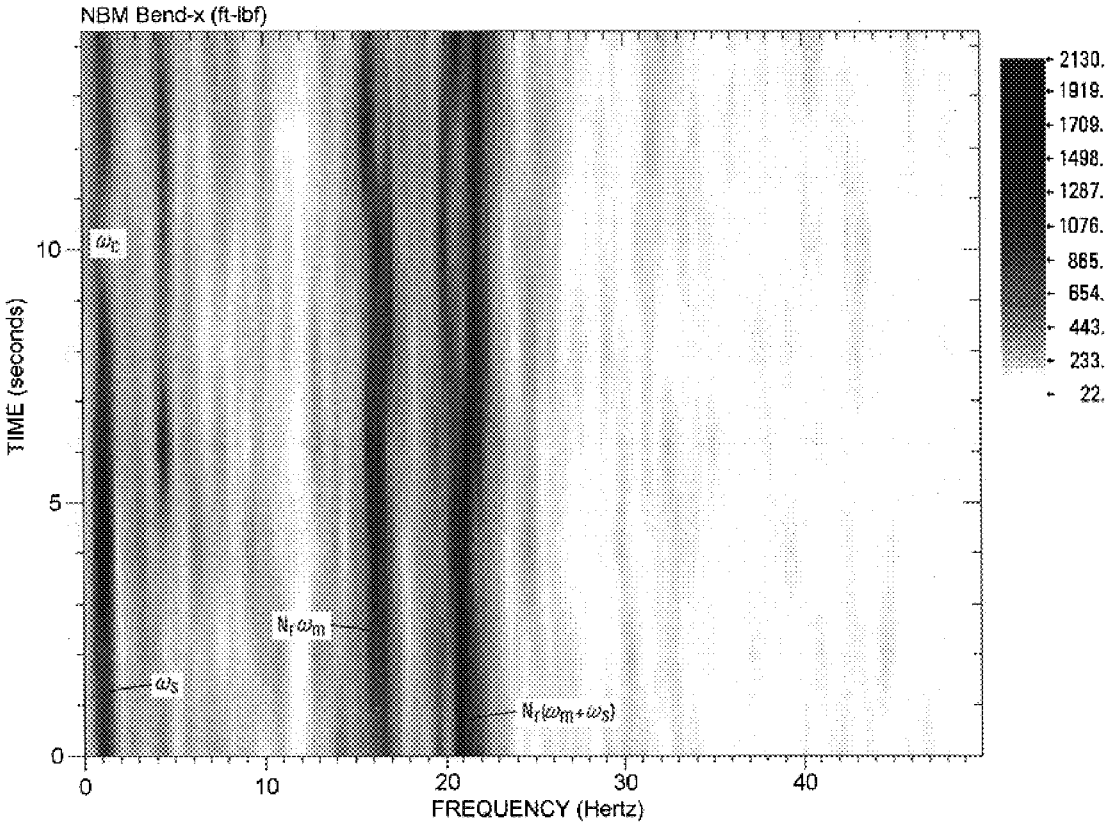
FIGS. 7 and 8 take the data of FIG. 5 for bending moment and convert it to the frequency domain.
Figure 8:
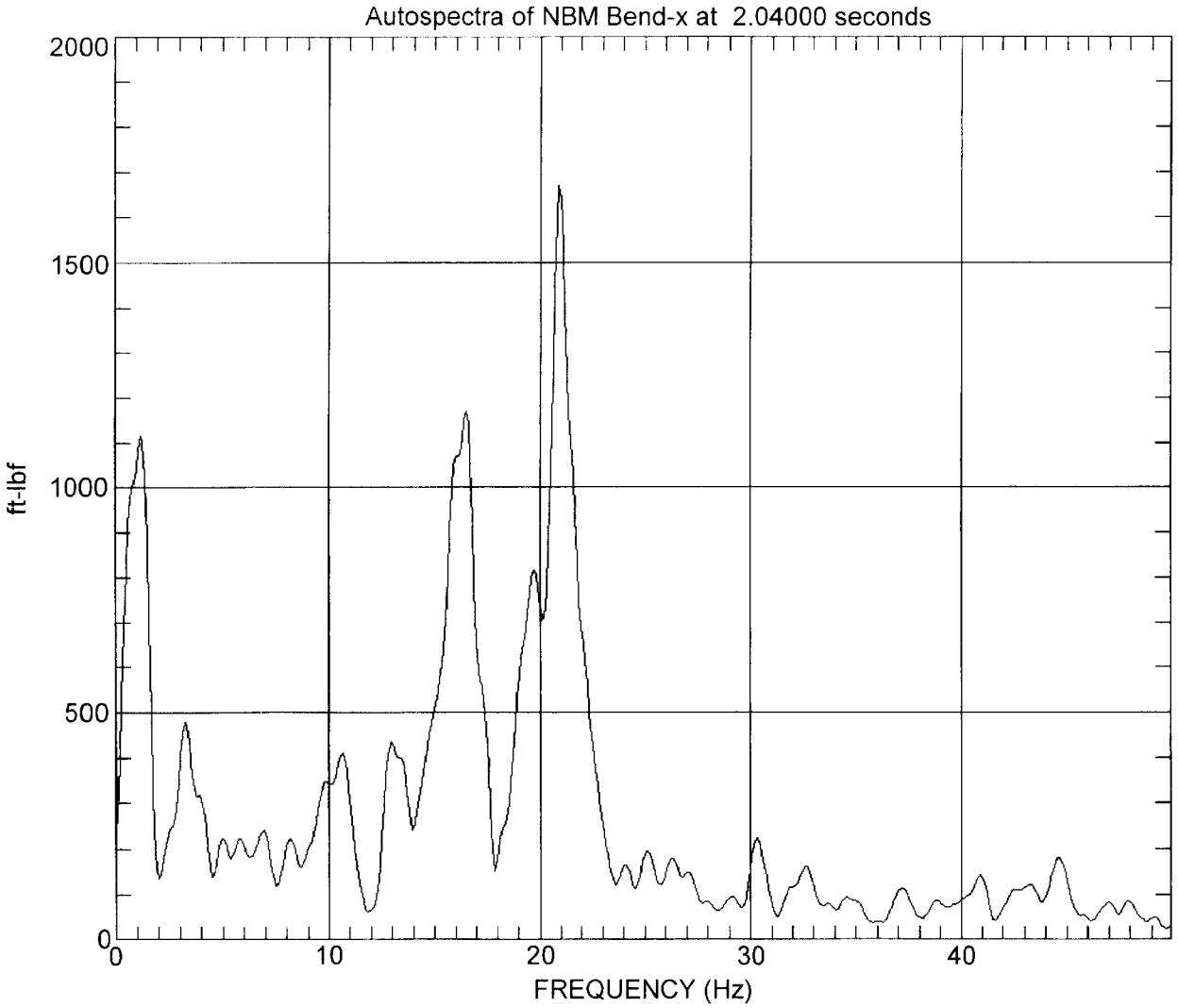
Figure 9:
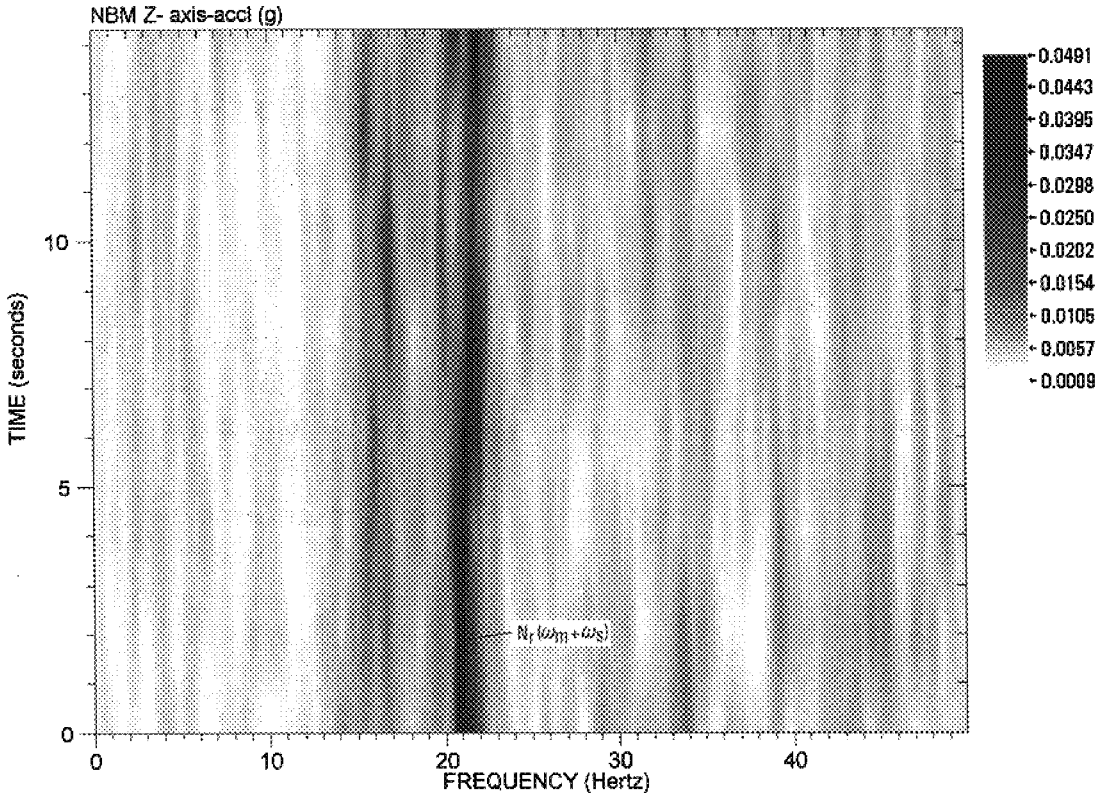
FIGS. 9 and 10 represent the spectrogram and frequency spectra at the indicated time, respectively, for raw data from FIG. 6.
Figure 10:
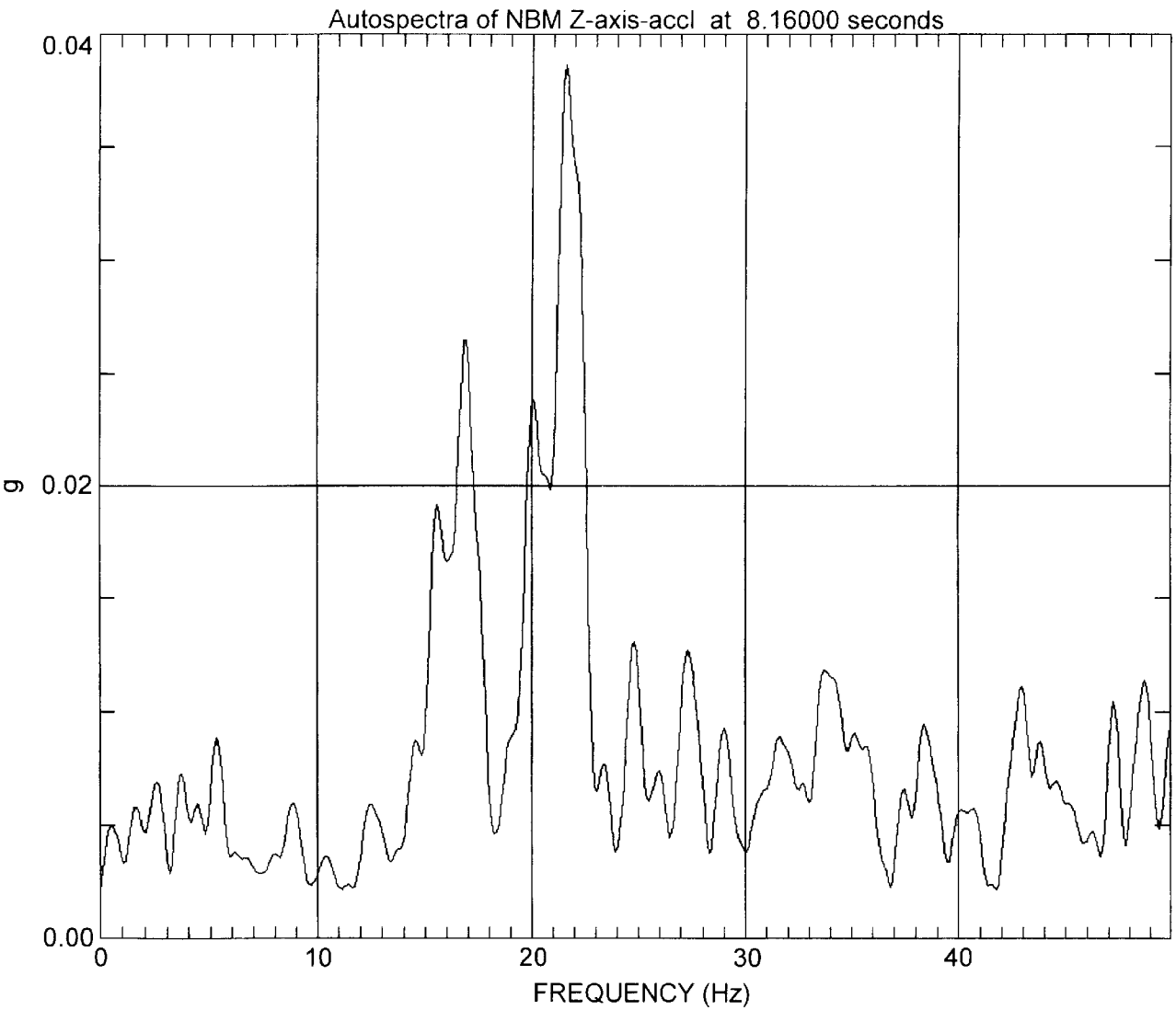
Figure 11:
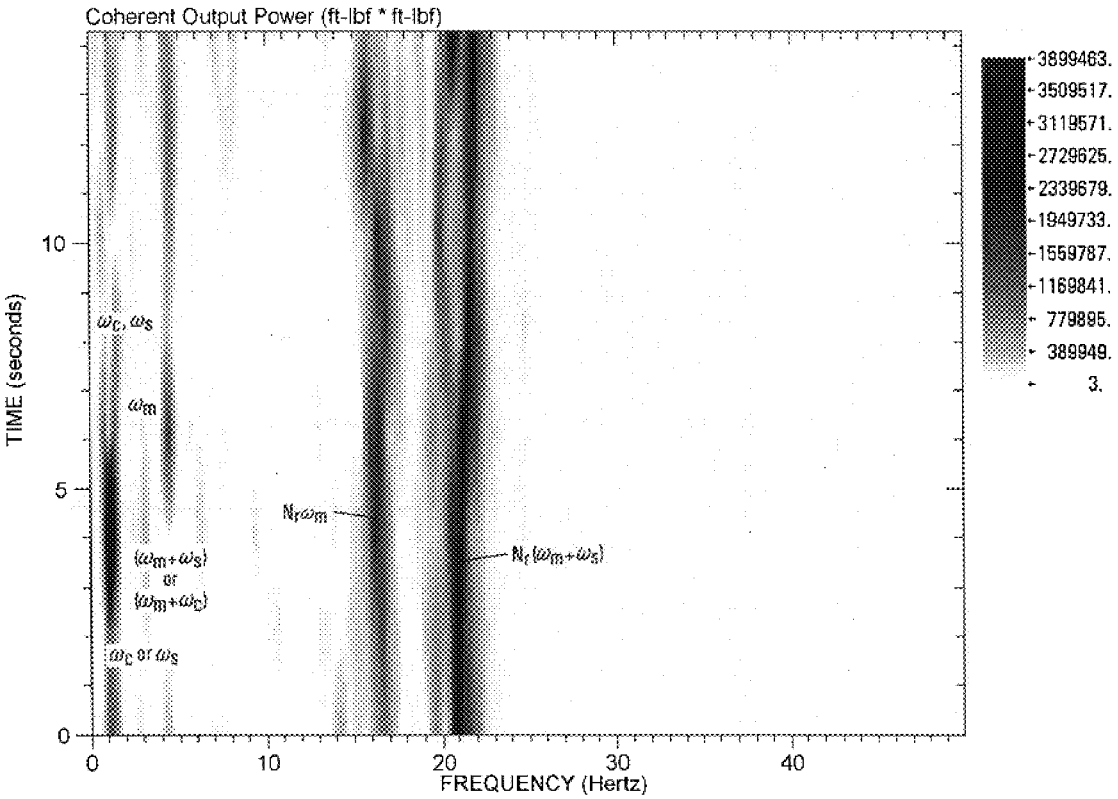
FIGS. 11 and 12 represent a presentation of the coherent output power of the two signals in FIGS. 5 and 6, which show a lower frequency peak corresponding to motor whirl frequency and a higher frequency peak corresponding to the modulated whirl frequency.

FIGS. 5 and 6 represent the raw data, plotting amplitude of bending in the x direction and acceleration in the z direction. The raw data, which is obtained by the bottomhole assembly shown in FIGS. 1 and 2 and further depicted in FIGS. 5 and 6, is converted to spectrograms illustrated, respectively, in FIGS. 7 and 9, for the x bending moment and z acceleration. These spectrograms in FIGS. 7 and 9 show a cluster of high-amplitude frequencies between 15 and 20 Hz. The spectrograms were obtained using the FFT technique. This technique is described in (1) J. W. Corley & J. W. Tukey, "An Algorithm For Machine Calculations Complex Fourier Series," Meth. of Comp., vol. 19, No. 90, pp. 297–301, 1956; (2) Special Issue on Fast Fourier Transform, IEEE Trans. Audio & electroacoustics, vol. AU-15, June 1967; and (3) N. Thrane, "The Discrete Fourier Transform & FFT Analyzers," Brüel & Kjaer Technical Review, No. 1, 1979. The two spectrograms show discrete amplitude peaks at frequencies about 4–6 Hz apart. In all cases, the amplitude peaks at the higher frequency are always present, and the amplitude peaks at the lower frequencies are, in some cases, comparatively weak in amplitude. The lower frequency, lower-amplitude peak corresponds to the motor whirl frequency $\omega_m N_r$, and the higher amplitude peak corresponds to a modulated motor whirl frequency $N_r(\omega_m+n\omega_m)$. Using the coherent output power technique which overlays the spectrograms of FIGS. 7 and 9, the resultant spectrogram of the coherent output power is illustrated in FIG. 11. The coherent output power (COP) is the measurement of that part of the output autospectrum for z-axis acceleration (FIG. 9) that is fully coherent with the input signal for bending moment in the x direction given by the spectrogram of FIG. 7. The COP is given by the following relation: $COP(f)=Y^2(f).G_{bb}(f)$, where $Y^2(f)$ is the coherence function between the two measurements, $G_{bb}(f)$ represents the autospectrum of either two measurements and f the frequency in Hz.

Figure 12:
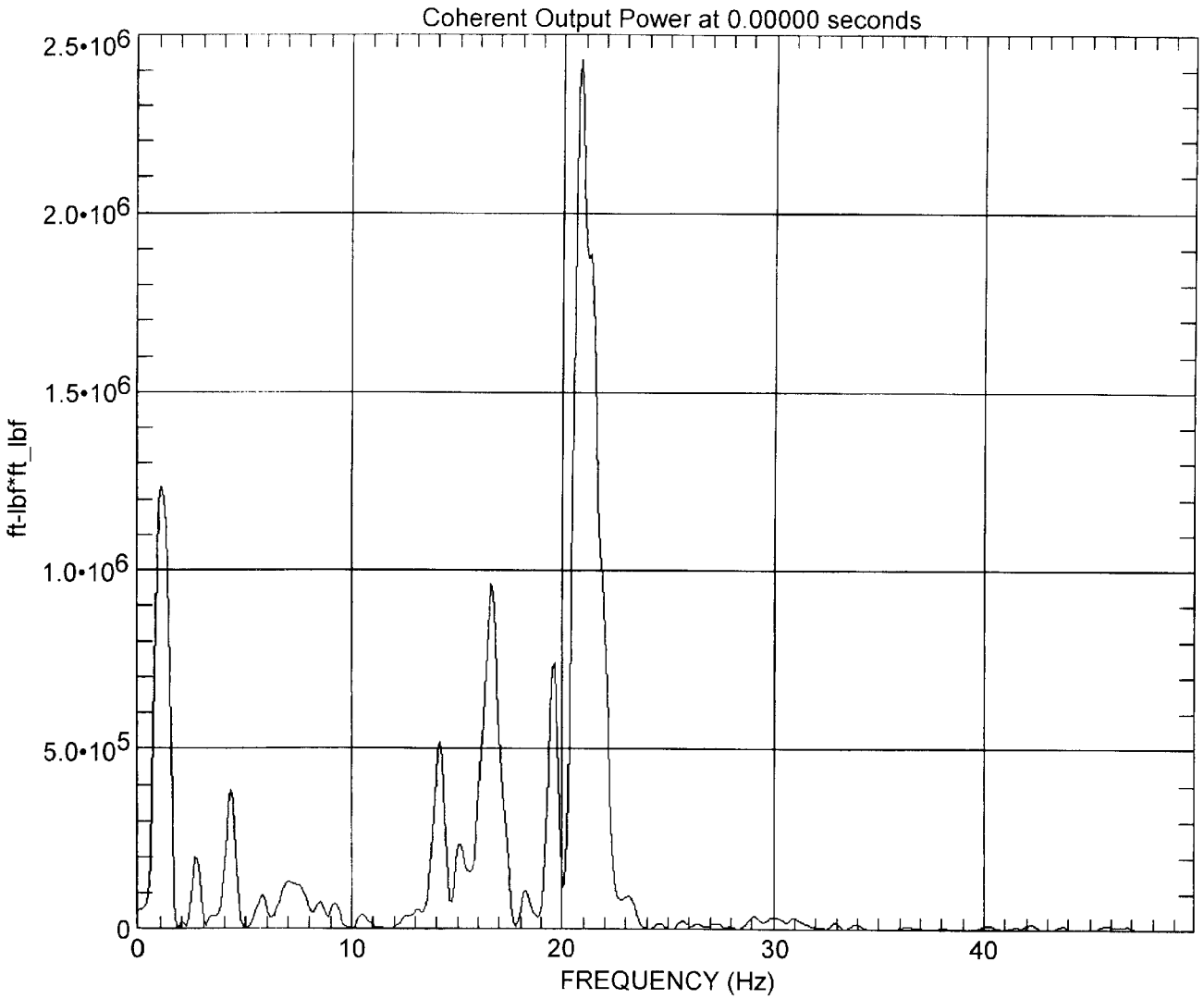

Referring now to FIG. 11, the COP plot shows two distinct peaks with most noise removed at 21 and 16.5 Hz at the start time and 21.5 and 17 Hz peaks at the elapsed time of about 12 seconds. Since the pump stroke frequency $\omega_s$ is known, and the spectrogram of FIG. 11 clearly delineates the whirl and modulated whirl frequencies, the rpm of the motor can be computed, knowing the number of lobes in the rotor and using the formulas given above. FIGS. 11 and 12 also reveal that between the frequency peaks, there are smaller low amplitude peaks corresponding to other frequencies which can also be seen. Outside of the frequency peaks illustrated in FIGS. 11 and 12, there can also be seen other frequencies which are not of interest in the COP analytical technique.

Figure 13:
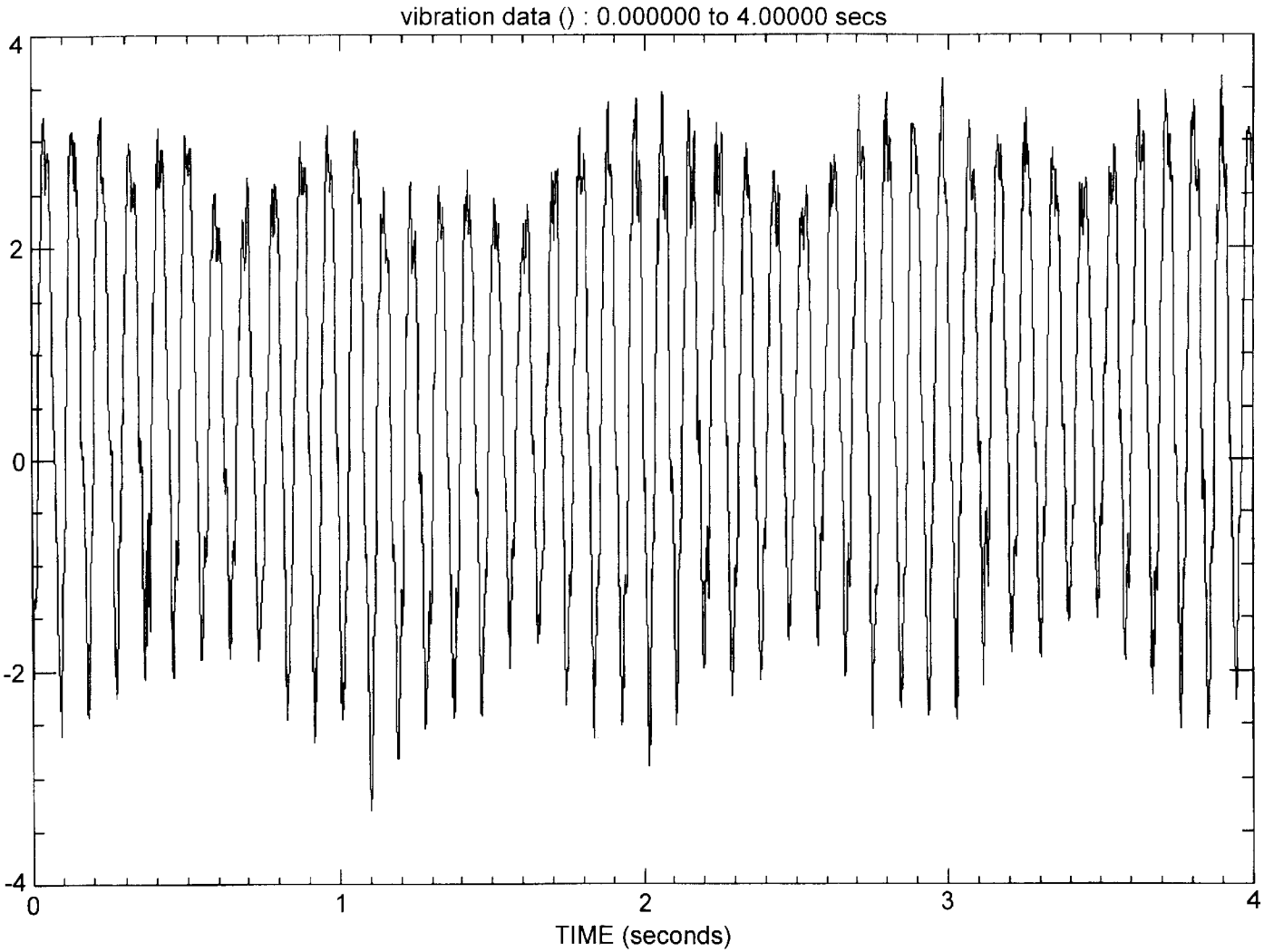
FIGS. 13 and 14 show raw vibration and pressure data from a downhole motor test.
Figure 14:
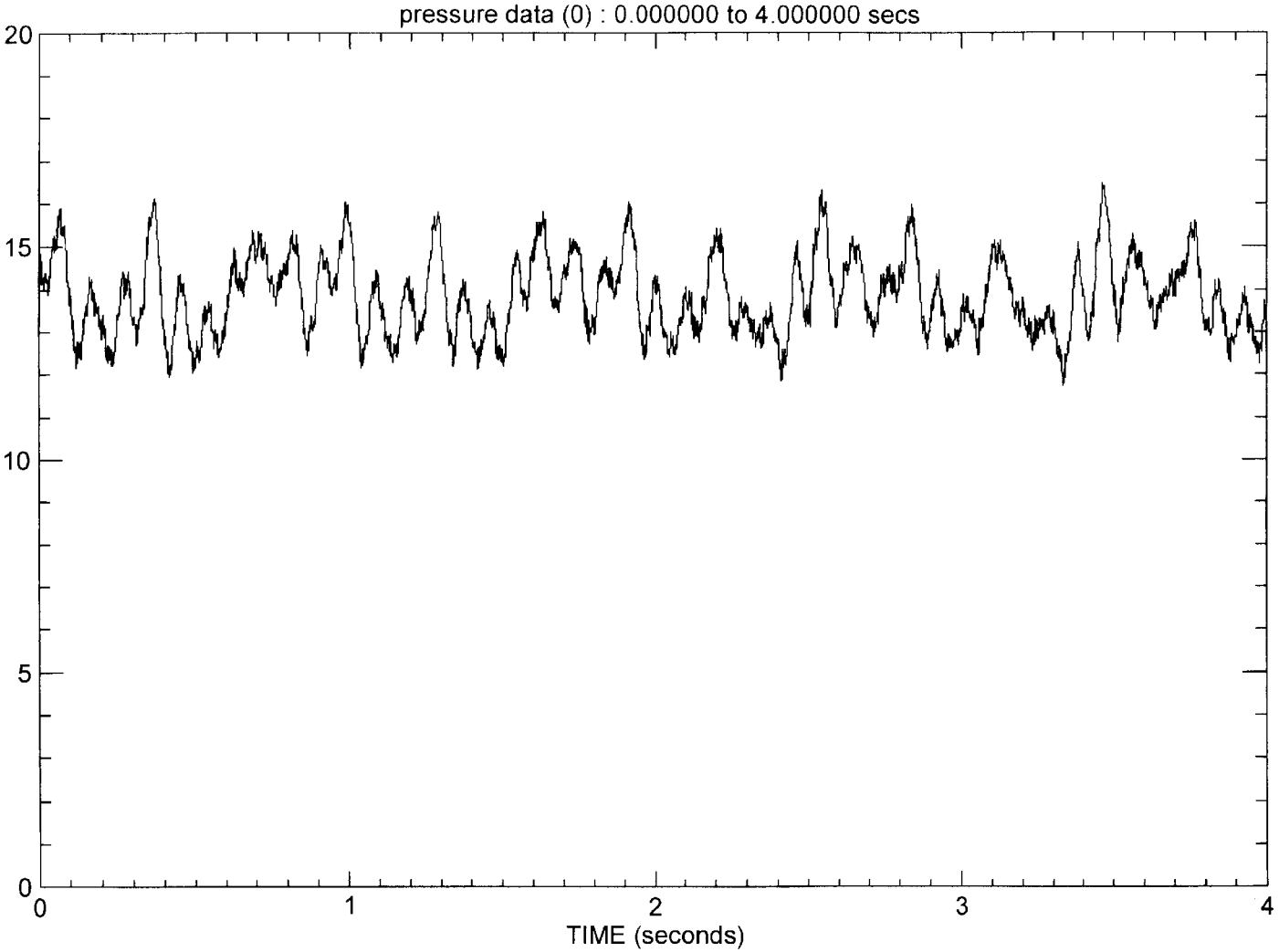
Figure 15:
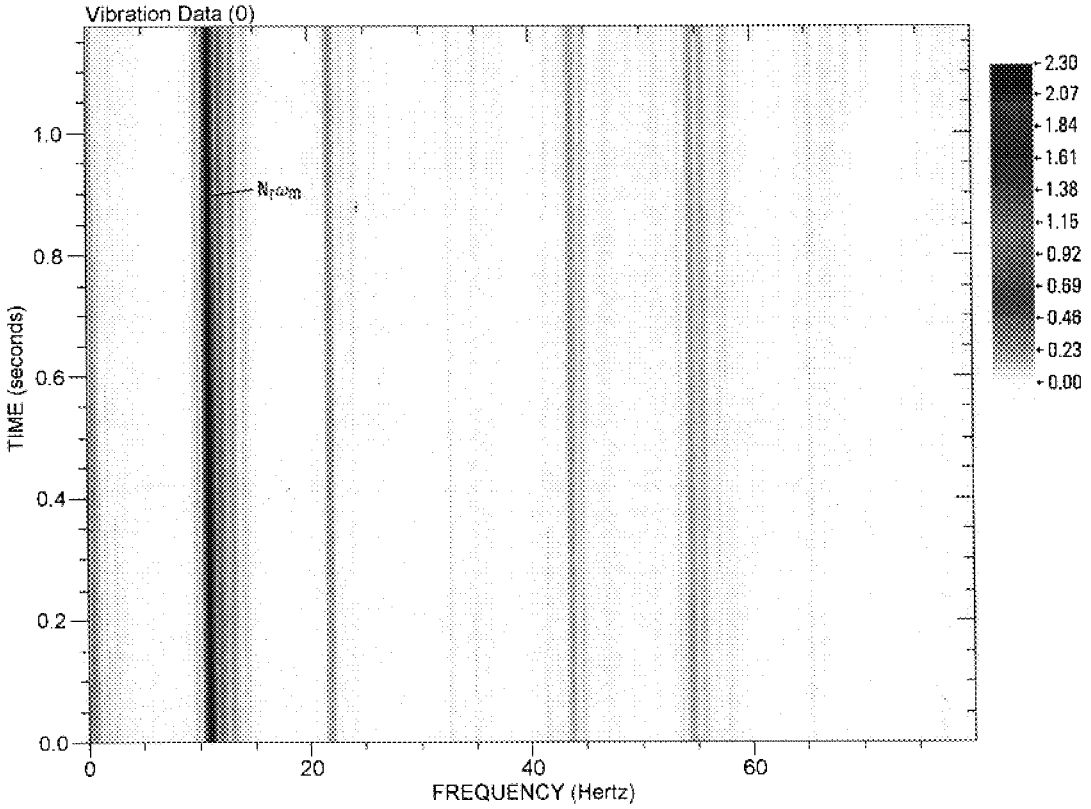
FIGS. 15 and 16 show the spectrogram and frequency spectra for the vibration data of FIG. 13.
Figure 16:
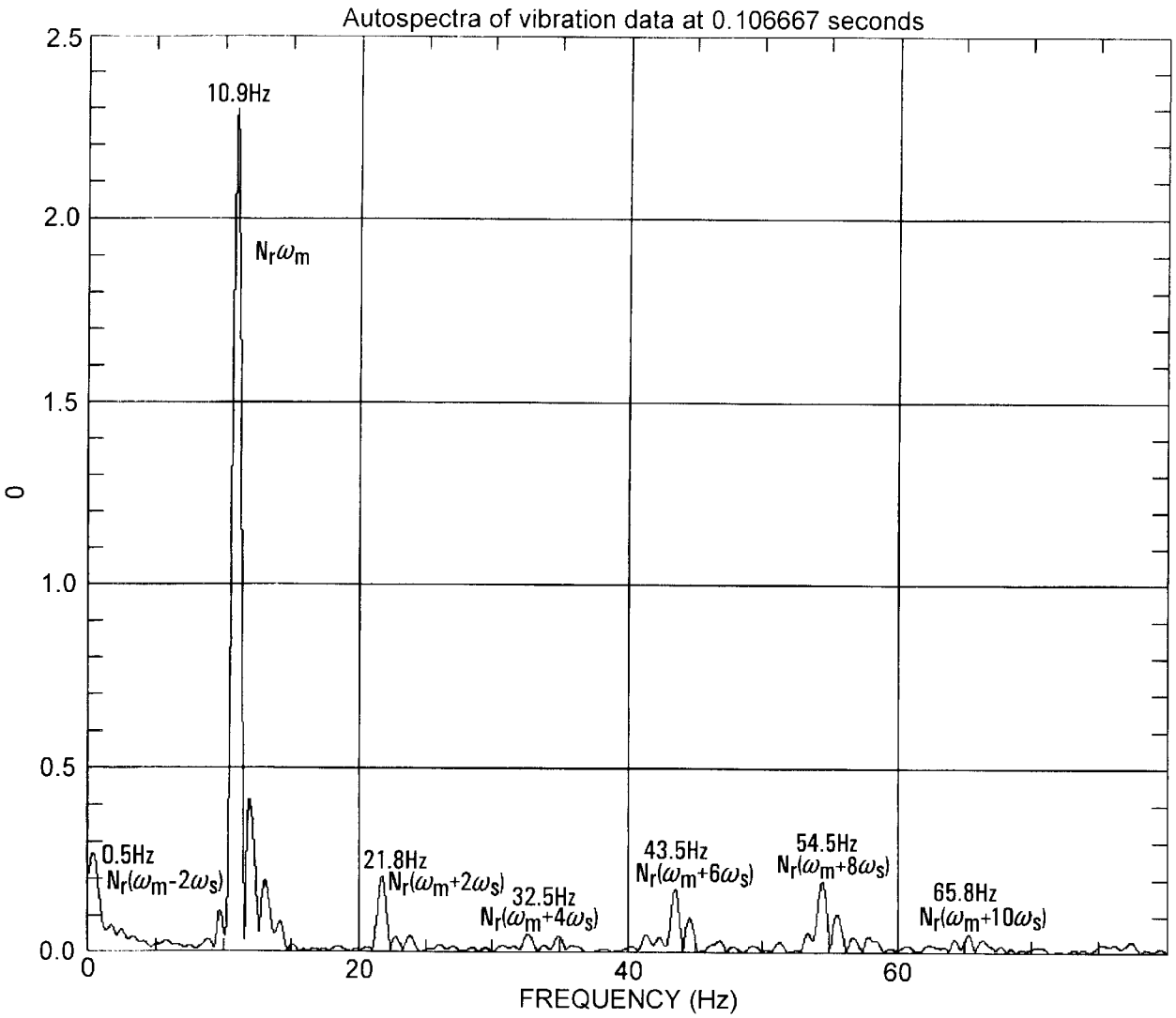
Figure 17:
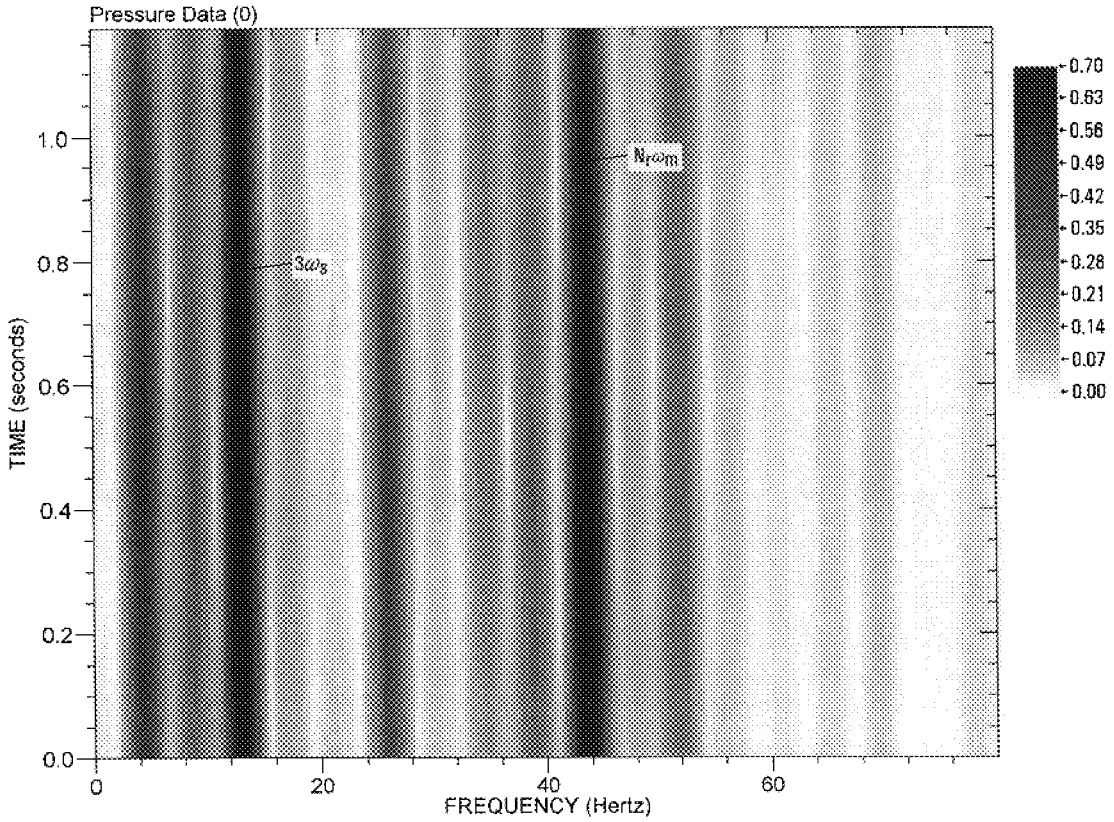
FIGS. 17 and 18 show similar plots for the pressure data in FIG. 14.

FIGS. 13–20 represent results from laboratory tests as opposed to the field tests reflected in FIGS. 5–12. This test involved firmly supporting the stator in a jig while fluid was pumped through the rotor. Thus, the vibration data does not reflect the impacts of the stator housing against the borehole wall. The vibration data for this bench test is far more ordered than the field vibration data which incorporates encounters of the stator with the borehole wall. Just as seen in the field data in FIGS. 5–12, due to the coupling between the motor and fluid, modulated frequencies due to pressure and whirl signals are present in both vibration and pressure data. The COP analysis is repeated for this data to isolate common frequencies and eliminate others. In the case of FIGS. 13–20, pressure and vibration data are used as the two data sets. The raw data is reflected in FIGS. 13 and 14, which are, respectively, measurements of the amplitude of vibration with respect to time and the pressure amplitude with respect to time. Within each graph on FIGS. 13 and 14, there are repeating patterns which are more easily seen when spectrograms are created using the FFT technique. These spectrograms, which correspond to FIGS. 13 and 14, are, respectively, FIGS. 15 and 17. FIGS. 15 and 17 show the typical spectrograms for motor vibrations and fluid pressure for the data set shown in FIGS. 13 and 14. FIGS. 15 and 16 show a typical spectrogram and the frequency plot for vibration data from a Mach 1 motor. The spectrogram shows a high-amplitude peak at around 10.9 Hz followed by smaller peaks at other frequencies. This peak, shown in FIGS. 15 and 16 at 10.9 Hz, corresponds to the motor whirl frequency $N_r\omega_m$, and the rest of the smaller peaks represent the modulated motor whirl frequency peaks given by $N_r(\omega_m \pm n\omega_s)$. Since the motor whirl frequency is given by the expression $\omega_m N_r$, the measured value of 10.9 Hz is used to calculate the motor rotational frequency at 2.18 Hz, which in turn corresponds to a rotor speed of 131 rpm. This correlated with an actual measurement of the rotor speed of 137 rpm. The rotor speed was computed using the formula previously provided that $rpm=\omega_m/2\pi.60$, where $\omega_m$ is the motor frequency in radians per second.

Figure 18:
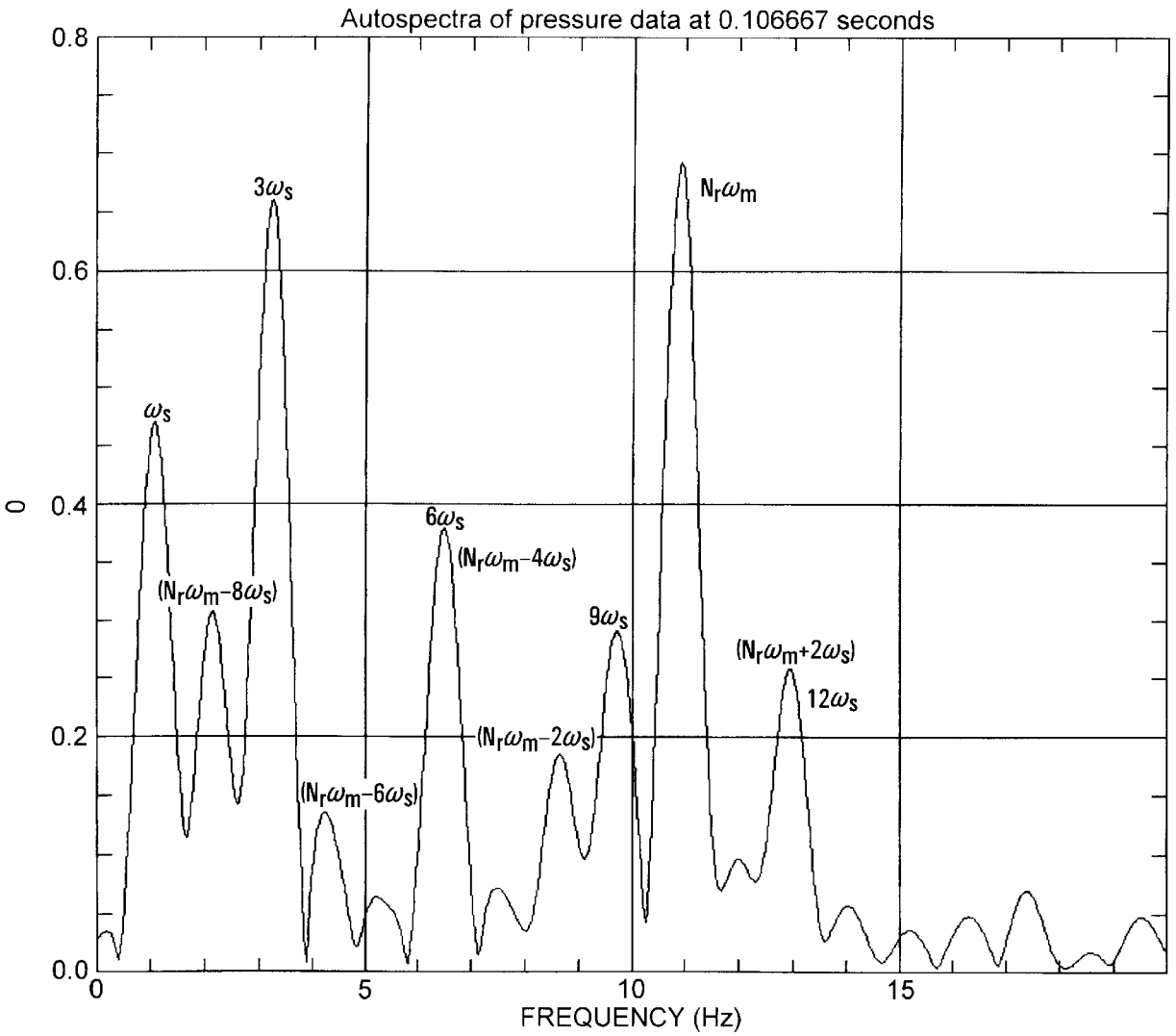
Figure 19:
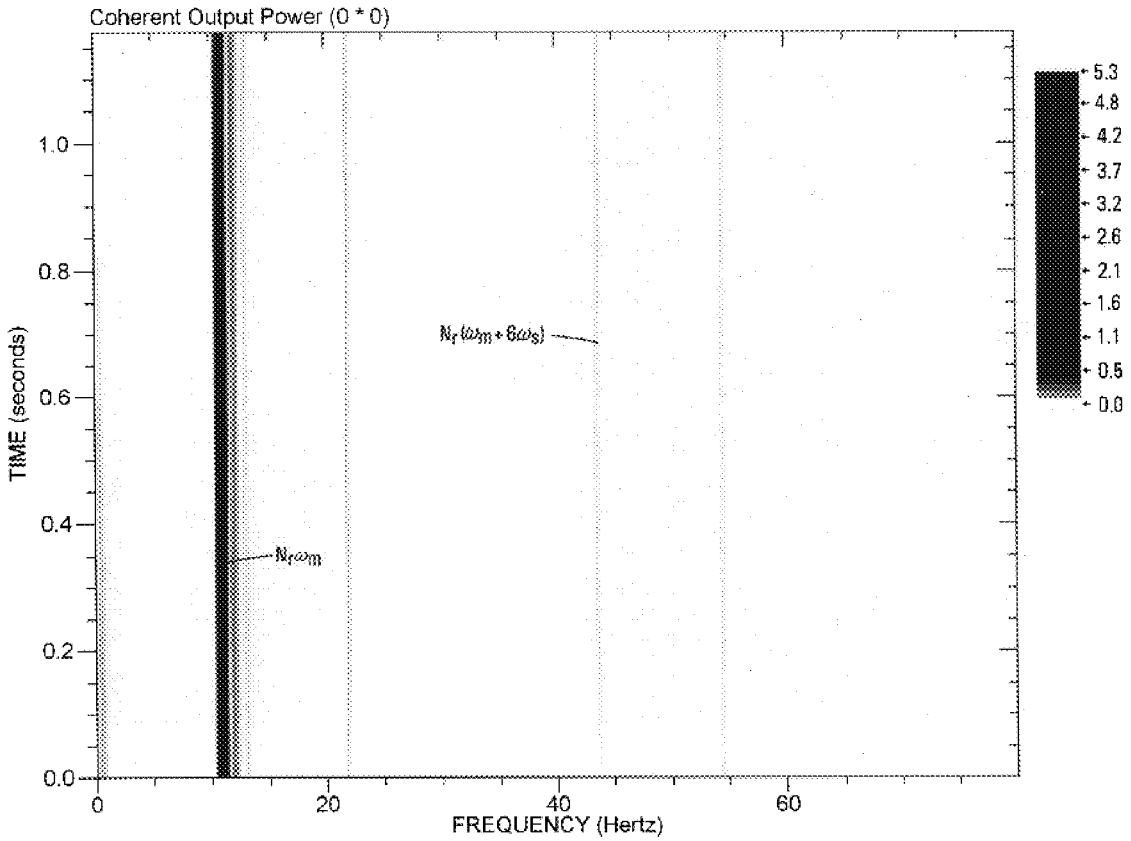
FIGS. 19 and 20 represent the coherent output power of the two signals of FIGS. 15 and 17, indicating a high amplitude frequency peak at $N_r\omega_m$, followed by smaller peaks at modulated frequencies with all other noise eliminated.
Figure 20:
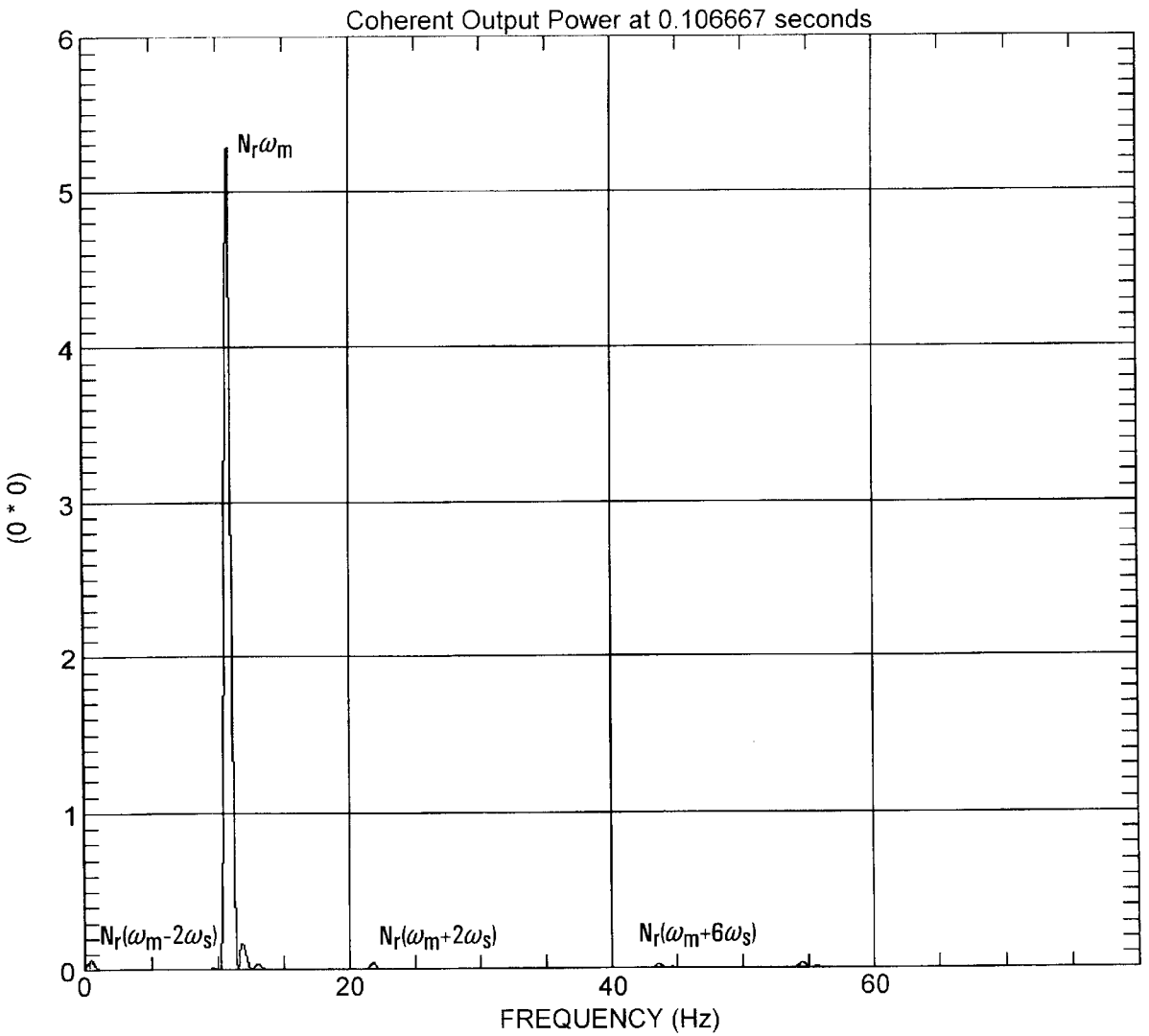

FIG. 17 is the spectrogram of the pressure data, with the related frequency plot being FIG. 18. Both of these figures show peaks at multiples of $\omega_s$, with $\omega_s$ being the pump stroke frequency. There are higher amplitude peaks at 3, 6, and 9 times $\omega_s$. In addition, these spectrograms reveal modulated peaks, as previously derived, corresponding to frequencies at $n\omega_s \pm N_r\omega_m$. A higher amplitude peak, which corresponds to the motor whirl frequency $N_r\omega_m$ at 10.9 Hz, can also be seen. Since there is a coupling between the fluid and the motor, it is possible that modulated frequencies due to pressure and whirl signals could be present in the fluid and the motor. To isolate such frequencies and eliminate others, a dual-channel frequency analysis is performed to compute the COP of the two signals. FIGS. 19 and 20 represent the COP which shows one high-amplitude frequency peak at $N_r\omega_m$ Hz, followed by smaller peaks at modulated frequencies with all other noise eliminated. Thus, the analysis of the COP of the pressure data and the vibration data both yield the whirl frequency from which the rotor speed can be computed.

Those skilled in the art can appreciate that motor speeds can be estimated or computed either from bending moment or acceleration measurements; however, a dual-channel analysis using COP, which uses both the measurements as shown in FIGS. 11 and 12, reduces noise and singles out the dominant frequencies where the whirl and modulated whirl frequencies are the high amplitude, dominant or main frequencies. The motor speed is not always completely visible in the cluster of frequencies which are shown in the spectrograms, but it can be obtained indirectly from two distinctly visible frequencies—one which represents the motor whirl frequency and the other, the modulated whirl frequency. The modulation frequency corresponds to the frequency of pump strokes from the surface pumping equipment. The other frequencies visible on the spectrogram are frequencies stemming from the rotation of the drillstring at the surface, modulated surface pumping equipment frequency due to piston strokes in the surface pumping equipment, and bit rotational frequency. FIGS. 13–20 illustrate that there is a coupling between the downhole motor 20 frequency and the surface pump frequency. Using the COP analysis proves to be a very significant tool in isolating the motor whirl frequency from pressure and/or vibration data sets. From this information, which is available on a real-time basis, the rotor speed can easily be computed from the whirl frequency during drilling.

One of the important features of the method of the present invention is the ability to use vibration data which is available on a real-time basis from the bottomhole assembly for real-time feedback to the surface of the rotor speed. Using the COP analytical technique, the whirl frequency and the modulated whirl frequency of the rotor can be seen from transformed data starting with x axis bending measurements and z axis acceleration measurements, shown in FIGS. 5 and 6. Similarly, by using vibration data, as shown in FIG. 13, and/or pressure data, as shown in FIG. 14, the rotor speed can be computed. In the case of the vibration data from FIG. 13, the spectrogram FIGS. 15 and 16 directly reveal the whirl frequency from which the motor rpm can be directly calculated. In the case of the pressure data from the spectrogram of FIG. 17, when used with the vibration data spectrogram of FIG. 15 and the COP analysis, reveals the resultant spectrogram of FIG. 19, clearly indicating the whirl frequency of the rotor from which the rotor speed can be computed.

Thus, with an understanding that there is an interplay between the pumped fluid through the downhole motor and the frequency of whirl of the rotor, frequency data obtained from measurements taken by instruments in the bottomhole assembly can be used to observe and pull out the whirl frequency correlating to the rotor, as well as the modified whirl frequency which exists due to the interrelationship between the pump fluid from the reciprocating pumping equipment at the surface and the whirl pattern of the rotor with the resulting frequencies relating to the rotor speed using a known formula. Using instruments that are normally part of the bottomhole assembly will reveal the base data from which the COP analysis can be used. The raw data is first transformed using the known FFT technique to create the spectrograms as illustrated above. Use of the known COP technique with the spectrograms of related phenomena yields a clear delineation of the frequency attributable to whirl and the modified whirl frequencies due to the effect of the frequencies of the surface pumping equipment. The COP technique is described in detail in "Frequency Analysis," R. B. Randall, available from Brüek & Kjaer, Denmark, Revised ed. 1987, pp. 234. This technique is applicable using two variables measured by the bottomhole assembly. In the examples given above, bending moment in the x direction, in conjunction with acceleration in the z direction, transformed into spectrograms using the FFT technique and then correlated using the COP technique, has resulted in isolation of the motor whirl frequency for a computation of the rotor speed. Vibration data of FIG. 13, transformed into the spectrogram of FIG. 15, yields directly the whirl frequency of the rotor. The pressure data reflected in FIG. 14 can also be combined with the vibration data of FIG. 13, using the same technique, with the ultimate COP resultant shown in FIG. 19, which again confirms the frequency of whirl of the rotor in the downhole motor from which speed can be computed quite accurately. Alternative starting data points for this type of analysis can be the following combination of measurements such as torsional stress with lateral or axial vibration. All of these measurements are readily available from the downhole equipment in a typical bottomhole assembly during drilling. The preferred way is to use real-time measurements of interrelated phenomena and apply the FFT technique for conversion of the data to the frequency domain and, in conjunction with the COP technique, compute the whirl frequency from which rotor speed is determined. Only one measured variable, preferably bending, can be used with this FFT technique to determine motor speed in real time (see FIG. 15 as illustrative of a low-noise situation amenable to a single measured variable analysis). Using only one measured variable can result in excessive noise which would limit the ability to isolate motor-related frequencies. In this case, two measured variables can be used to eliminate noise, as previously described. With the method of the present invention, inaccuracies using manufacturers' curves are eliminated as the analysis of rotor speed for the downhole motor derives directly from actual measurements downhole on a real-time basis.

The foregoing disclosure and description of the invention are illustrative and explanatory thereof, and various changes in the size, shape and materials, as well as in the details of the illustrated construction, may be made without departing from the spirit of the invention.

What is claimed:

1. A method of determining the rotor speed of a progressing cavity motor in downhole use, comprising:

measuring at least one operating parameter of the motor;

using said measured parameter to determine at least one frequency associated with whirl of a rotor of said motor;

computing rotor speed from said frequency associated with whirl of said rotor of said motor.

2. The method of claim 1, further comprising:

measuring two interrelated operating parameters of the rotor;

measuring said operating parameters on a real-time basis.

3. The method of claim 2, further comprising:

converting said measured operating parameters into a frequency domain.

4. The method of claim 3, further comprising:

using an FFT technique to convert said measured operating parameters to a frequency domain.

5. The method of claim 4, further comprising:

sensing at least one high amplitude peak on the frequency domain data for each measured operating parameter.

6. The method of claim 5, further comprising:

correlating at least one high amplitude peak from the frequency domain data of one measured operating parameter with a high amplitude peak from the frequency domain data of the other measured operating parameter.

7. The method of claim 6, further comprising:

using a coherent output power technique to accomplish said correlation.

8. The method of claim 7, further comprising:

identifying at least one frequency at which said coherent output power technique reveals that a correlated high amplitude for both measured operating parameters exists.

9. The method of claim 8, further comprising:

attributing said frequency corresponding to said correlated high amplitudes of both measured operating parameters to said whirl or modified whirl frequencies of said rotor.

10. The method of claim 9, further comprising:

computing rotor speed use of said frequency attributed to said whirl or said modified whirl of said rotor and the number of lobes on said rotor.

11. The method of claim 9, further comprising:

identifying a plurality of frequencies corresponding to said correlated high amplitudes as associated with the whirl and modified whirl of said rotor;

computing rotor speed from either or both of said whirl-related frequencies.

12. The method of claim 10, further comprising:

using motor bending moment in a first plane and acceleration force in a perpendicular second plane as said interrelated operating parameters.

13. The method of claim 10, further comprising:

using motor vibration and pressure as said interrelated operating parameters.

14. The method of claim 10, further comprising:

using torsional stress with either lateral or axial vibration as said interrelated operating parameters.

15. The method of claim 2, further comprising:

using motor bending moment in a first plane and acceleration force in a perpendicular second plane as said interrelated operating parameters.

16. The method of claim 2, further comprising:

using motor vibration and pressure as said interrelated operating parameters.

17. The method of claim 2, further comprising:

using torsional stress with either lateral or axial vibration as said interrelated operating parameters.

18. The method of claim 1, further comprising:

using bending moment as the operating parameter.

19. The method of claim 2, further comprising:

using bending moment as one of the two parameters.

* * * * *